US010035968B2

(12) United States Patent
Salomon et al.

(10) Patent No.: US 10,035,968 B2
(45) Date of Patent: Jul. 31, 2018

(54) FUNCTIONALIZED COPOLYMERS AND LUBRICATING COMPOSITIONS THEREOF

(75) Inventors: Mary F. Salomon, Mayfield Village, OH (US); Julie A. Edgar, Chagrin Falls, OH (US); William R. S. Barton, Belper (GB); Mark R. Baker, Midland, MI (US); Michael E. Huston, Painesville, OH (US)

(73) Assignee: THE LUBRIZOL CORPORATION, Wickliffe, OH (US)

( * ) Notice: Subject to any disclaimer, the term of this patent is extended or adjusted under 35 U.S.C. 154(b) by 450 days.

(21) Appl. No.: 13/995,219

(22) PCT Filed: Dec. 16, 2011

(86) PCT No.: PCT/US2011/065347

§ 371 (c)(1),
(2), (4) Date: Nov. 5, 2013

(87) PCT Pub. No.: WO2012/087781

PCT Pub. Date: Jun. 28, 2012

(65) Prior Publication Data

US 2014/0051615 A1 Feb. 20, 2014

Related U.S. Application Data

(60) Provisional application No. 61/425,276, filed on Dec. 21, 2010.

(51) Int. Cl.

| | |
|---|---|
| ***C10M 135/36*** | (2006.01) |
| ***C07D 285/12*** | (2006.01) |
| ***C10M 151/02*** | (2006.01) |

(52) U.S. Cl.

CPC ..... *C10M 135/36* (2013.01); *C10M 151/02* (2013.01); *C10M 2205/028* (2013.01); *C10M 2205/0285* (2013.01); *C10M 2209/086* (2013.01); *C10M 2215/04* (2013.01); *C10M 2215/28* (2013.01); *C10M 2219/022* (2013.01); *C10M 2219/046* (2013.01); *C10M 2219/106* (2013.01); *C10M 2221/02* (2013.01); *C10N 2210/02* (2013.01); *C10N 2230/06* (2013.01); *C10N 2230/12* (2013.01); *C10N 2230/76* (2013.01); *C10N 2240/04* (2013.01); *C10N 2240/042* (2013.01); *C10N 2240/044* (2013.01); *C10N 2260/14* (2013.01)

(58) Field of Classification Search

CPC ..... C10M 149/12; C10M 149/14
USPC ..... 508/273, 274
See application file for complete search history.

(56) References Cited

U.S. PATENT DOCUMENTS

| | | | | |
|---|---|---|---|---|
| 4,526,950 | A | 7/1985 | Grava | |
| 5,274,102 | A * | 12/1993 | Marolewski | C08F 222/14 508/223 |
| 5,435,928 | A | 7/1995 | Beck | |
| 6,174,843 | B1 | 1/2001 | Peyton et al. | |
| 6,419,714 | B2 | 7/2002 | Thompson et al. | |
| 6,544,935 | B1 * | 4/2003 | Vargo | C08F 8/32 508/232 |
| 6,573,224 | B2 | 6/2003 | McNeil et al. | |

FOREIGN PATENT DOCUMENTS

| | | |
|---|---|---|
| EP | 1857533 | 11/2011 |
| WO | 2007/133999 | 11/2007 |
| WO | 2010/014655 | 2/2010 |

OTHER PUBLICATIONS

Corresponding International Publication No. WO 2012/087781 A1 7 Search Report published Jun. 28, 2012.
Written Opinion from corresponding International Application No. PCT/US2011/065347 filed Dec. 16, 2011.

* cited by examiner

*Primary Examiner* — James C Goloboy
*Assistant Examiner* — Francis C Campanell
(74) *Attorney, Agent, or Firm* — Christopher P. Demas; Teresan W. Gilbert

(57) ABSTRACT

The present invention relates to a lubricating composition containing an oil of lubricating viscosity and a dimercaptothiadiazole salt of a copolymer comprising units derived from monomers (i) an ?-olefin and (ii) an ethylenically unsaturated carboxylic acid or derivatives thereof (typically carboxylic acid groups or an anhydride), are partially esterified with an alcohol, or mixtures thereof, and wherein at least a portion of carboxylic acid groups not esterified are reacted with an amine. The invention further provides for a lubricating composition containing said copolymer. The invention further provides a method and use of lubricating composition in a mechanical device.

16 Claims, No Drawings

FUNCTIONALIZED COPOLYMERS AND LUBRICATING COMPOSITIONS THEREOF

FIELD OF INVENTION

The present invention relates to a lubricating composition containing an oil of lubricating viscosity and a dimercaptothiadiazole salt of a copolymer comprising units derived from monomers (i) an α-olefin and (ii) an ethylenically unsaturated carboxylic acid or derivatives thereof (typically carboxylic acid groups or an anhydride), are partially esterified with an alcohol, or mixtures thereof, and wherein at least a portion of carboxylic acid groups not esterified are reacted with an amine. The invention further provides for a lubricating composition containing said copolymer. The invention further provides a method and use of lubricating composition in a mechanical device.

BACKGROUND OF THE INVENTION

Viscosity index improvers are known to be added to lubricating oil compositions to improve the viscosity index of the lubricant. Typical viscosity index improvers include polymers of methacrylates, acrylates, olefins (such as copolymers of alpha-olefins and maleic anhydride and esterified derivatives thereof), or maleic-anhydride styrene copolymers, and esterified derivatives thereof. However, such viscosity index improvers can have poor shear stability, too high a viscosity at low temperature, poor fuel economy, and poor non-dispersant cleanliness.

U.S. Pat. Nos. 6,573,224; 6,174,843 6,419,714; and 4,526,950, and International Application WO 07/133999 all disclose olefin copolymers for lubricating compositions.

International publication WO2010/014655 A discloses a copolymer comprising units derived from monomers (i) an α-olefin and (ii) an ethylenically unsaturated carboxylic acid or derivatives thereof esterified with a primary alcohol branched at the β- or higher position, wherein the copolymer, prior to esterification, has a reduced specific viscosity of up to 0.08. The copolymer is useful to provide to a lubricant composition with at least one of acceptable or improved shear stability, acceptable or improved viscosity index control, acceptable or improved low temperature viscosity and acceptable or improved oxidation control.

Many lubricants contain sulphur-containing additives such as sulphurised olefins, alkyl sulphides, or various dimercaptothiadiazoles. These additives are known to provide extreme pressure performance in various mechanical devices such as driveline devices. However, the sulphur-containing additives may in some instances cause copper corrosion, or increased odour, or improved handling.

SUMMARY OF THE INVENTION

An objective of the present invention is to provide an antiwear additive and/or extreme pressure additive capable of utilization in a lubricating composition. Another objective of the present invention is to provide an additive capable of at least one of the following decreased metal corrosion (in particular copper corrosion), and decreased odour, The antiwear additive and/or extreme pressure additive may also be capable of allowing for a reduction in the amount of sulphur-containing additives (such as sulphurised olefins or polysulphides). The present invention may also be capable of reducing scuffing and minimizing gear distress under shock loading.

In one embodiment the invention provides a lubricating composition comprising an oil of lubricating viscosity and a dimercaptothiadiazole salt of an amine-functionalized esterified copolymer, wherein the esterified copolymer comprises units derived from monomers: (i) an α-olefin and (ii) an ethylenically unsaturated carboxylic acid or derivatives thereof (typically carboxylic acid groups or an anhydride), are partially esterified with an alcohol, or mixtures thereof, and wherein at least a portion of carboxylic acid groups not esterified are reacted with an amine. Reaction with the amine may be referred to as capping with an amine. The reacted amine copolymer is typically capable of forming a salt by reaction with a dimercaptothiadiazole, i.e., dimercaptothiadiazole or an acidic derivative thereof. The copolymer may have a measurable TBN (as determined by ASTM method D2986).

The dimercaptothiadiazole salt may be derivable from 2,5-dimercapto-1,3,4-thiadiazole or a hydrocarbyl-substituted 2,5-di-mercapto-1,3,4-thiadiazole, or oligomers thereof.

In one embodiment the invention provides a lubricating composition comprising an oil of lubricating viscosity and a dimercaptothiadiazole salt of a copolymer comprising units derived from monomers (i) an α-olefin and (ii) an ethylenically unsaturated carboxylic acid or derivatives thereof (typically carboxylic acid groups or an anhydride), are partially esterified with an alcohol, or mixtures thereof, and wherein at least a portion of carboxylic acid groups not esterified are reacted with an amine, wherein the alcohol may be a primary alcohol and branched at the β- or higher position. Typically the amine may be a diamine or polyamine. Alternatively, the amine may be provided as an amine-containing monomer.

In one embodiment the copolymer may have, prior to esterification, a reduced specific viscosity of up to 0.08, or 0.02 to 0.08 (or 0.02 to 0.07, 0.03 to 0.07 or 0.04 to 0.06). Typically the RSV ranges described herein are based on the mean of three measurements made on the copolymer.

The copolymer may instead of RSV be defined in terms of weight average molecular weight. Typically the weight average molecular weight is measured on the final esterified copolymer, capped with an amine. The weight average molecular weight may be 5000 to 20,000, or 13,000 to 18,000.

The copolymer reduced specific viscosity (RSV) is measured by the formula RSV=(Relative Viscosity−1)/Concentration, wherein the relative viscosity is determined by measuring, by means of a dilution viscometer, the viscosity of a solution of 1.6 g of the copolymer in 100 $cm^3$ of acetone and the viscosity of acetone at 30° C. A more detailed description of RSV is provided below. The RSV is determined for the copolymer of an α-olefin and (ii) an ethylenically unsaturated carboxylic acid or derivatives thereof before esterification.

In one embodiment the copolymer described above comprises at least one ester group and a nitrogen containing group (such as amino-, amido- and/or imido-group), typically sufficient to provide 0.01 wt % to 1.5 wt % (or 0.02 wt % to 0.75 wt %, or 0.04 wt % to 0.25 wt %) nitrogen to the copolymer. Typically an amide, ester or imide may be attached to a pendant aminoalkyl group, such that there is a free amino group (or basic amino group capable of salting).

In one embodiment the copolymer may be derived from monomers (i) an α-olefin and (ii) an ethylenically unsaturated carboxylic acid or derivatives thereof, wherein 0.1 to 99.89 (or 1 to 50, or 2.5 to 20, or 5 to 15) percent of the carboxylic acid units esterified are functionalised with a primary alcohol branched at the β- or higher position, wherein 0.1 to 99.89 (or 1 to 50, or 2.5 to 20, or 5 to 15) percent of the carboxylic acid units that are esterified, are esterified with a linear alcohol or an alpha-branched alcohol, wherein 0.01 to 10% (or 0.1% to 20%, or 0.02% to 7.5%, or 0.1 to 5%, or 0.1 to less than 2%) of the carboxylic acid units are functionalised and have a nitrogen containing group with at least one of an amino-, amido- and/or imido-group (and may typically include an aminoalkyl ester, an aminoalkyl amide, or an aminoalkyl imide). In one embodiment the copolymer has a reduced specific viscosity of up to 0.08. Typically the amine may be reacted with the copolymer after polymerisation.

The copolymer of the invention is reacted with a 2,5-dimercapto-1,3,4-thiadiazole or a hydrocarbyl-substituted 2,5-di-mercapto-1,3,4-thiadiazole, or oligomers thereof.

In one embodiment the invention provides a lubricant or lubricant concentrate obtained (or obtainable) by admixing the copolymer of the invention with (i) an oil of lubricating viscosity, and (ii) at least one other performance additive (as defined below).

In one embodiment the invention provides a method of lubricating a mechanical device comprising supplying to the mechanical device a lubricating composition comprising an oil of lubricating viscosity and a dimercaptothiadiazole salt of an amine-functionalized esterified copolymer, wherein the esterified copolymer comprises units derived from monomers: (i) an α-olefin and (ii) an ethylenically unsaturated carboxylic acid or derivatives thereof (typically carboxylic acid groups or an anhydride), are partially esterified with an alcohol, or mixtures thereof, and wherein at least a portion of carboxylic acid groups not esterified are reacted with an amine. Reaction with the amine may be referred to as capping with an amine. In one embodiment the mechanical device may be driveline device.

In one embodiment the invention provides for the use of the copolymer disclosed herein to provide to a lubricant composition with extreme pressure performance and at least one (or all) of decreased metal corrosion (in particular copper corrosion), and decreased odour.

DETAILED DESCRIPTION OF THE INVENTION

The present invention provides a lubricating composition, a method and use as described above. In one embodiment the invention also provides a process for the preparation of the copolymer of the present invention.

A measurement correlating with molecular weight of the copolymer (or interpolymer such as an alternating copolymer) may be expressed in terms of the "reduced specific viscosity" of the copolymer which is a recognised means of expressing the molecular size of a polymeric substance. As used herein, the reduced specific viscosity (abbreviated as RSV) is the value typically obtained in accordance with the formula RSV=(Relative Viscosity−1)/Concentration, wherein the relative viscosity is determined by measuring, by means of a dilution viscometer, the viscosity of a solution of 1.6 g of the polymer in 100 $cm^3$ of acetone and the viscosity of acetone at 30° C. For purpose of computation by the above formula, the concentration is adjusted to 1.6 g of the copolymer per 100 $cm^3$ of acetone. A more detailed discussion of the reduced specific viscosity, also known as the specific viscosity, as well as its relationship to the average molecular weight of a copolymer, appears in Paul J. Flory, Principles of Polymer Chemistry, (1953 Edition) pages 308 et seq.

As used herein, the term "(meth)acryl" and related terms includes both acrylic and methacrylic groups.

The Copolymer

The copolymer of the invention prepared by the reaction of monomers (i) an α-olefin and (ii) an ethylenically unsaturated carboxylic acid or derivatives thereof.

The α-olefin may be a linear or branched olefin, or mixtures thereof. If the α-olefin is linear, the number of carbon atoms of the α-olefin may range from 2 to 20, or 4 to 16, or 8 to 12. If the α-olefin is branched, the number of carbon atoms of the α-olefin may range from 4 to 32, or 6 to 20, or 8 to 16. Examples of an α-olefin include 1-decene, 1-undecene, 1-dodecene, 1-tridecene, 1-tetradecene, 1-pentadecene, 1-hexadecene, 1-heptadecene 1-octadecene, or mixtures thereof. An example of a useful α-olefin is 1-dodecene.

The units derived from the ethylenically unsaturated carboxylic acid or derivatives thereof may be an acid or anhydride or derivatives thereof that may be partially esterified (before or after polymerisation, typically after polymerisation). When partially esterified, other functional groups include acids, salts, imides, and amides, or mixtures thereof. Suitable salts include alkali metal, alkaline earth metal salts, or mixtures thereof. The salts include lithium, sodium, potassium, magnesium, calcium salts, or mixtures thereof. The unsaturated carboxylic acid or derivatives thereof includes acrylic acid, methyl acrylate, methacrylic acid, maleic acid or anhydride, fumaric acid, itaconic acid or anhydride or mixtures thereof, or substituted equivalents thereof.

Suitable examples of the ethylenically unsaturated carboxylic acid or derivatives thereof include itaconic anhydride, maleic anhydride, methyl maleic anhydride, ethyl maleic anhydride, dimethyl maleic anhydride or mixtures thereof. In one embodiment the ethylenically unsaturated carboxylic acid or derivatives thereof includes maleic anhydride, (meth)acrylic acid, or derivatives thereof such as esters and nitrogen-containing monomers. Such nitrogen-containing monomers include an amino-hydrocarbyl morpholine (such as n-aminopropylmorpholine), an aminoalcohol, N,N-dimethyl acrylamide, a N-vinyl carbonamide (such as N-vinyl formamide, N-vinyl acetamide, N-vinyl propionamide, N-vinyl hydroxyacetamide), vinyl pyridine, N-vinyl imidazole, N-vinyl pyrrolidinone, N-vinyl caproplactam, a dialkylaminoalkyl(meth)acrylamide or dialkylaminoalkyl(meth)acrylate, a N-substituted alkanediamine (such as N-methyl-1,3-propanediamine), or mixtures thereof. Those that contain basic nitrogen functionality may be particularly suitable; those may include vinyl pyridine, N-vinyl imidazole, a dialkylaminoalkyl(meth)acrylamide or dialkylaminoalkyl(meth)acrylate, a N-substituted alkanediamine, or mixtures thereof.

The copolymer may be prepared as is described in International publication WO2010/014655 A. For example, the copolymer of the invention prepared by the reaction of monomers (i) an α-olefin and (ii) an ethylenically unsaturated carboxylic acid or derivatives thereof are described in paragraph [0140] to [0141] of WO2010/014655 A. The copolymer may in one embodiment be a copolymer derived from 1-dodecene and maleic anhydride. Exemplified copolymers include those prepared below. The esterification and reaction of the acid monomer with an amine may occur prior to or after polymerization of the monomers; typically after polymerization.

Copolymer Backbone Preparation: A copolymer may be prepared by reacting in a 3 litre flask 1 mole of maleic anhydride, and Y moles (defined below) of 1-dodecene in the presence of 60 wt % of toluene solvent. The flask is fitted with a flange lid and clip, PTFE stirrer gland, rod and overhead stirrer, thermocouple, nitrogen inlet port and water-cooled condenser. Nitrogen is blown through the flask at 0.028 $m^3$/hr (or 1 SCFH). A separate 500 ml flask with a side arm is charged with 0.05 moles of tert-butyl peroxy-2-ethylhexanoate initiator (a commercially available initiator from Akzo Nobel, known as Trigonox®21S), optionally n-dodecyl mercaptan (chain transfer agent, CTA) and additional toluene. A nitrogen line is fitted to the arm and nitrogen is applied at 0.085 $m^3$/hr (or 0.3 SCFH) for 30 minutes. The 3 litre flask is heated to 105° C. The Trigonox 21S initiator/toluene mixture is pumped from the 500 ml flask into the 3 litre flask via a Masterflex™ pump (flow rate set at 0.8 ml/min) over a period of 5 hours. The contents of the 3 litre flask are stirred for 1 hour before cooling to 95° C. The contents of the 3 litre flask are stirred overnight. Typically a clear colourless gel is obtained. The amount of each reagent is shown in the table below.

The copolymers prepared are characterised by RSV method described in the description above. The RSV data is presented in the table.

| Copolymer Prep Example | Y moles of 1-Dodecene | Mole Ratio of CTA to Initiator | RSV |
|---|---|---|---|
| Cpp1 | 1 | 0:1 | 0.058 |
| Cpp2 | 0.95 | 0:1 | 0.071 |

The copolymer may optionally be prepared in the presence of a free radical initiator, solvent, chain transfer agent, or mixtures thereof. A person skilled in the art will appreciate that altering the amount of initiator and/or chain transfer agent will alter the number average molecular weight and RSV of the copolymer of the invention.

The solvent is known and is normally a liquid organic diluent. Generally, the solvent has a boiling point high enough to provide the required reaction temperature. Illustrative diluents include toluene, t-butyl benzene, benzene, xylene, chlorobenzene and various petroleum fractions boiling above 125° C.

The free radical initiator is known and includes peroxy compounds, peroxides, hydroperoxides, and azo compounds which decompose thermally to provide free radicals. Other suitable examples are described in J. Brandrup and E. Immergut, Editor, "Polymer Handbook", 2nd edition, John Wiley and Sons, New York (1975), pages II-1 to II-40. Examples of a free radical initiator include those derived from a free radical-generating reagent, and examples include benzoyl peroxide, t-butyl perbenzoate, t-butyl metachloroperbenzoate, t-butyl peroxide, sec-butylperoxydicarbonate, azobisisobutyronitrile, t-butyl peroxide, t-butyl hydroperoxide, t-amyl peroxide, cumyl peroxide, t-butyl peroctoate, t-butyl-m-chloroperbenzoate, azobisisovaleronitrile or mixtures thereof. In one embodiment the free radical generating reagent is t-butyl peroxide, t-butyl hydroperoxide, t-amyl peroxide, cumyl peroxide, t-butyl peroctoate, t-butyl-m-chloroperbenzoate, azobisisovaleronitrile or mixtures thereof. Commercially available free radical initiators include classes of compound sold under the trademark Trigonox®-21 from Akzo Nobel.

The chain transfer agent is known to a person skilled in the art. The chain transfer agent may be added to a polymerisation as a means of controlling the molecular weight of the polymer. The chain transfer agent may include a sulphur-containing chain transfer agent such as n- and t-dodecyl mercaptan, 2-mercaptoethanol, methyl-3-mercaptopropionate. Terpenes can also be used. Typically the chain transfer agent may be n- and t-dodecyl mercaptan.

The esterified copolymer may be formed by reaction of carboxylic acid groups of the ethylenically unsaturated carboxylic acid or derivatives thereof. The alcohol may be a linear or branched alcohol, a cyclic or acyclic alcohol, or a combination of features thereof. The alcohol typically reacts with the units derived from the ethylenically unsaturated carboxylic acid or derivatives thereof (before or after polymerization, typically after) to form esterified groups.

The esterified groups may be derivable from linear or branched alcohols. The alcohol may have 1 to 150, or 4 to 50, or 8 to 20 carbon atoms. Typically the number of carbon atoms is sufficient to make the copolymer of the invention dispersible or soluble in oil.

In different embodiments the alcohol may be a primary alcohol branched at the β- or higher position may have at least 12 (or at least 16, or at least 18 or at least 20) carbon atoms. The number of carbon atoms may range from at least 12 to 60, or at least 16 to 30.

The alcohol may be a fatty alcohol of various chain lengths (typically containing 6 to 20, or 8 to 18, or 10 to 15 carbon atoms). The fatty alcohol includes Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann.

The esterified groups may be derivable from Guerbet alcohols. Guerbet alcohols typically have one or more carbon chains with branching at the β- or higher position. The Guerbet alcohols may contain 10 to 60, or 12 to 60, or 16 to 40 carbon atoms. Methods to prepare Guerbet alcohols are disclosed in U.S. Pat. No. 4,767,815 (see column 5, line 39 to column 6, line 32).

The Guerbet alcohols may have alkyl groups including the following:

1) alkyl groups containing $C_{15-16}$ polymethylene groups, such as 2-$C_{1-15}$ alkyl-hexadecyl groups (e.g. 2-octylhexadecyl) and 2-alkyl-octadecyl groups (e.g. 2-ethyloctadecyl, 2-tetradecyl-octadecyl and 2-hexadecyloctadecyl);

2) alkyl groups containing $C_{13-14}$ polymethylene groups, such as 1-$C_{1-15}$ alkyl-tetradecyl groups (e.g. 2-hexyltetradecyl, 2-decyltetradecyl and 2-undecyltridecyl) and 2-$C_{1-15}$ alkyl-hexadecyl groups (e.g. 2-ethyl-hexadecyl and 2-dodecylhexadecyl);

3) alkyl groups containing $C_{10-12}$polymethylene groups, such as 2-$C_{1-15}$ alkyl-dodecyl groups (e.g. 2-octyldodecyl) and 2-$C_{1-15}$ alkyl-dodecyl groups (2-hexyldodecyl and 2-octyldodecyl), 2-$C_{1-15}$ alkyl-tetradecyl groups (e.g. 2-hexyltetradecyl and 2-decyltetradecyl);

4) alkyl groups containing $C_{6-9}$polymethylene groups, such as 2-$C_{1-15}$ alkyl-decyl groups (e.g. 2-octyldecyl) and 2,4-di-$C_{1-15}$ alkyl-decyl groups (e.g. 2-ethyl-4-butyl-decyl group);

5) alkyl groups containing $C_{1-5}$ polymethylene groups, such as 2-(3-methylhexyl)-7-methyl-decyl and 2-(1,4,4-trimethylbutyl)-5,7,7-trimethyl-octyl groups; and 6) and mixtures of two or more branched alkyl groups, such as alkyl residues of oxoalcohols corresponding to propylene oligomers (from hexamer to undecamer), ethylene/propylene (molar ratio 16:1-1:11) oligomers, iso-butene oligomers (from pentamer to octamer), $C_{5-17}$ α-olefin oligomers (from dimer to hexamer).

Typically the Guerbet alcohol has two alkyl groups with the difference in the number of carbon atoms between the two alkyl groups of 4 or less relative to the longer chain alkyl group.

Examples of suitable primary alcohol branched at the β- or higher position include 2-ethylhexanol, 2-butyloctanol, 2-hexyldecanol, 2-octyl-dodecanol, 2-decyltetradecanol, or mixtures thereof.

In one embodiment the alcohol comprises a mixture of (i) a Guerbet alcohol and (ii) a linear alcohol other than a Guerbet alcohol. The other alcohol may be a fatty alcohol described above.

The copolymer of the invention may be esterified in the presence of an alcohol described above. In one embodiment, the esterified copolymer may be further treated with an alcohol (such as a C1-C6 alcohol, typically butanol) to react with residual carboxylic acid groups of the copolymer, thus reducing the acid number to a desired value. The esterification reaction of the alcohol with the ethylenically unsaturated carboxylic acid or derivatives thereof is outlined below.

Esterified Copolymer: The esterified copolymer may be prepared in a flask fitted with a Dean-Stark trap capped with a condenser. An amount of copolymer containing 1 mole of carboxy groups is heated in the flask to 110° C. and stirred for 30 minutes. One mole of alcohol is added. If the amount of the primary alcohol branched at the β- or higher position to be charged is greater than one mole, only one mole is added at this point. Conversely if less than one mole of the primary alcohol branched at the β- or higher position is intended, sufficient linear alcohol is used to provide a total of one mole equivalent of alcohol. The alcohol is pumped into the flask via peristaltic pump over a period of 35 minutes. Catalytic amounts of methane sulphonic acid along with the remaining moles of alcohol are then pumped into the flask over a period of 5 hours whilst heating to and holding at 145° C. and removing water in the Dean-Stark trap.

The reaction temperature is reduced to 135° C., and sufficient butanol is added sequentially to the flask until the total acid number (TAN) is not higher than 4 mg KOH/g. The flask is heated to 150° C. and sufficient sodium hydroxide is added to quench the methanesulphonic acid. The flask is cooled to ambient temperature resulting in an esterified copolymer. Optionally, the product is vacuum stripped to remove any volatile materials such as water or alcohol.

The procedure may employ the materials listed in the table below.

| Ester Copolymer | Copolymer Prep | Moles of Linear Alcohol | Moles of Branched Alcohol B1 | B2 | B3 |
|---|---|---|---|---|---|
| Esc1 | Cpp1 | 2.0 | | | |
| Esc2 | Cpp1 | 1 | 1 | | |
| Esc3 | Cpp1 | 1 | | 1 | |
| Esc4 | Cpp1 | 1 | | | 1 |
| Esc5 | Cpp1 | 1.8 | 0.2 | | |
| Esc6 | Cpp1 | 1.8 | | 0.2 | |
| Esc7 | Cpp1 | 1.8 | | | 0.2 |
| Esc8 | Cpp1 | 0.5 | 1.5 | | |
| Esc9 | Cpp1 | 0.5 | | 1.5 | |
| Esc10 | Cpp1 | 0.5 | | | 1.5 |

-continued

| Ester Copolymer | Copolymer Prep | Moles of Linear Alcohol | Moles of Branched Alcohol B1 | B2 | B3 |
|---|---|---|---|---|---|
| Esc11 | Cpp1 | | 2 | | |
| Esc12 | Cpp1 | | | 2 | |
| Esc13 | Cpp1 | | | | 2 |

Footnote:
The linear alcohol is a $C_{8-10}$ mixture commercially available as Alfol ®810.
Minor amounts of butanol are not included in the reported amounts.
B1 is 2-hexyldecanol.
B2 is 2-ethylhexanol.
B3 is a 2-octyldodecanol.

Moles of alcohol referred to in the table relate to the total number of moles of alcohol relative to the total number carboxyl groups of the unsaturated carboxylic acid of the copolymer. Typically 2 moles of alcohol react with two moles of carboxyl groups derived from maleic anhydride.

The esterified copolymer may be further reacted with an amine. The amine may include any amine capable of providing, when incorporated onto the copolymer, a TBN (i.e., a total base number) of greater than 0 mg KOH/g, or 1 to 20 mg KOH/g, or 2 to 12 mg KOH/g).

Examples of the amine include an amino-hydrocarbyl morpholine (such as n-aminopropylmorpholine), an amino-alcohol, vinyl pyridine, N-vinyl imidazole, a dialkylamino-alkyl(meth)acrylamide or dialkylaminoalkyl(meth)acrylate, an N-substituted alkanediamine (such as N,N-dimethyl-1,3, propanediamine), or mixtures thereof.

Examples of the amine include an amino-hydrocarbyl morpholine (such as 3-morpholinopropylamine), an amino alcohol, an N-substituted alkanediamine (such as N,N-dimethyl-1,3-propanediamine), or mixtures thereof. In one embodiment the amine may be N,N-dimethyl-1,3-propanediamine.

In one embodiment the amine may be an amino-hydrocarbyl morpholine (such as 3-morpholinopropylamine), an aminoalcohol or mixtures thereof.

The aminoalcohol may include a monoalkanolamine, a dialkanolamine, a trialkanolamine or mixtures thereof. Examples of the aminoalcohol include dimethylethanolamine, ethanolamine, isopropanolamine, diethanolamine, triethanolamine, N,N-diethylethanolamine, N,N-dimethylethanolamine, N,N-dibutylethanolamine, 3-amino-1,2-propanediol, serinol, 2-amino-2-methyl-1,3-propanediol, tris(hydroxymethyl)-aminomethane, diisopropanolamine, N-methyldiethanolamine, 3-(dimethylamino)-2,2-dimethylpropan-1-ol, and 2-(2-aminoethylamino)ethanol.

When an amine such as an amino-hydrocarbyl morpholine or another non-hydroxy containing amine is used, the primary amino group tends to form an imide with the units derived from the ethylenically unsaturated carboxylic acid or derivatives thereof (before or after polymerisation, typically after polymerisation). In addition, the dimercaptothiadiazole salt tends to form by subsequent reaction of the dimercaptothiadiazole with the tertiary amine. For example the dimercaptothiadiazole salt tends to form by reaction with the tertiary amino group of incorporated amino-hydrocarbyl morpholine, or with the tertiary amino group of N,N-dialkyl hydrocarbyl (e.g., N,N-dimethylaminopropylamine reaction products).

In one embodiment the amine may be amino-hydrocarbyl morpholine, an aminoalcohol, or mixtures thereof.

When an amine such as an aminoalcohol is used, the alcohol group tends to form (i) an ester with the units derived from the ethylenically unsaturated carboxylic acid or derivatives thereof if the amino group is tertiary; and (ii) an ester or amide with the units derived from the ethylenically unsaturated carboxylic acid or derivatives thereof if the amino group is primary or secondary. In addition, the dimercaptothiadiazole salt tends to form by subsequent reaction of the dimercaptothiadiazole with the amino group.

The amine may also include an alkylene polyamine, or mixtures thereof. The alkylene polyamine may be an ethylene polyamine, propylene polyamine, butylene polyamine, or mixtures thereof. Typically the polyamine may be an ethylene polyamine, or mixtures thereof. Ethylene polyamines, such as some of those mentioned above, are preferred. They are described in detail under the heading "Diamines and Higher Amines" in Kirk Othmer's "Encyclopedia of Chemical Technology", 4th Edition, Vol. 8, pages 74-108, John Wiley and Sons, N.Y. (1993) and in Meinhardt, et al, U.S. Pat. No. 4,234,435.

Examples of ethylene polyamine include ethylenediamine, diethylenetriamine, triethylenetetramine, tetraethylenepentamine, pentaethylenehexamine, N-(2-aminoethyl)-N'-[2-[(2-aminoethyl)amino]ethyl]-1,2-ethanediamine, alkylene polyamine still bottoms, or mixtures thereof.

The alkylene polyamine bottoms may be characterized as having less than 2%, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex., designated "E-100" has a specific gravity at 15.6° C. of 1.0168, a percent nitrogen by weight of 33.15 and a viscosity at 40° C. of 121 cSt ($mm^2/s$). Gas chromatography analysis of such a sample showed it contains about 0.93% "Light Ends" (most probably diethylenetriamine), 0.72% triethylenetetramine, 21.74% tetraethylene pentamine and 76.61% pentaethylene hexamine and higher (by weight). A similar alkylene polyamine bottoms are commercially sold under as E100™ polyethyleneamines from Dow Chemical.

The copolymer of the invention may be reacted with an amine as is shown below.

Preparative Example of an Esterified Copolymer Capped with an Amine (Ecca): Each esterified copolymer from above is reacted with an amine in a flask fitted with a Dean-Stark trap capped with a condenser. Sufficient amine is added to provide the esterified copolymer with a weight percent nitrogen content as is shown in the table below. The amine is charged into the flask over a period of 30 minutes and stirred for 2-5 hours at 150° C. The flask is cooled to 115° C. and drained. The resultant product is vacuum stripped at 100-150° C. and held for 1.5-2.5 hours. The procedure employs the materials listed in the table below. The table below presents the information for a representative number of esterified copolymers capped with an amine.

| Ecca | Esterified Copolymer | Amine | Nitrogen Content (wt %) |
|---|---|---|---|
| Ecca1 | Esc1 | Amine 1 | 0.1 |
| Ecca2 | Esc2 | Amine 1 | 0.25 |
| Ecca3 | Esc3 | Amine 1 | 0.25 |
| Ecca4 | Esc3 | Amine 1 | 0.4 |

-continued

| Ecca | Esterified Copolymer | Amine | Nitrogen Content (wt %) |
|---|---|---|---|
| Ecca5 | Esc5 | Amine 2 | 0.1 |
| Ecca6 | Esc5 | Amine 2 | 0.25 |
| Ecca7 | Esc5 | Amine 2 | 0.4 |
| Ecca8 | Esc1 | Amine 2 | 0.1 |
| Ecca9 | Esc7 | Amine 2 | 0.1 |
| Ecca10 | Esc9 | Amine 2 | 0.25 |
| Ecca11 | Esc9 | Amine 3 | 0.15 |
| Ecca12 | Esc5 | Amine 3 | 0.375 |
| Ecca13 | Esc12 | Amine 3 | 0.6 |
| Ecca14 | Esc5 | Amine 1 | 0.1 |
| Ecca15 | Esc5 | Amine 1 | 0.25 |

Footnote:
Amine 1 is 4-(3-aminopropyl)morpholine
Amine 2 is 3-(dimethylamino)-1-propylamine
Amine 3 is 1-(3-aminopropyl) imidazole The dimercaptothiadiazole salt may be derivable from reacting the copolymer comprising units derived from monomers (i) an α-olefin and (ii) an ethylenically unsaturated carboxylic acid or derivatives thereof (typically carboxylic acid groups or an anhydride), are partially esterified with an alcohol, or mixtures thereof, and wherein at least a portion of carboxylic acid groups not esterified are reacted with an amine, wherein the amine has a TBN of greater than 0 mg KOH/g, or 1 to 20 mg KOH/g, or 2 to 12 mg KOH/g with a dimercaptothiadiazole.

In one embodiment the copolymer of the invention comprises (i) the α-olefin and (ii) an ethylenically unsaturated carboxylic acid or derivatives thereof (typically maleic anhydride), and (iii) one or more additional co-monomers that are known to copolymerize with the preceding monomers. Suitable co-monomers include vinyl aromatic monomers; alkyl meth(acrylates); vinyl acetate; and fumaric acid and derivatives thereof. The vinyl aromatic monomers include styrene or alkylstyrene (such as alpha-methylstyrene, para-tert-butylstyrene, alpha-ethylstyrene, and para-lower alkoxy styrene), or mixtures thereof. In one embodiment the vinyl aromatic monomer may be styrene.

The dimercaptothiadiazole salt may be derivable from reacting the an amine-functionalized esterified copolymer, wherein the esterified copolymer comprises units derived from monomers: (i) an α-olefin and (ii) an ethylenically unsaturated carboxylic acid or derivatives thereof (typically carboxylic acid groups or an anhydride), are partially esterified with an alcohol, or mixtures thereof, and wherein at least a portion of carboxylic acid groups not esterified are reacted with an amine having TBN of greater than 0 mg KOH/g, or 1 to 20 mg KOH/g, or 2 to 12 mg KOH/g with a dimercaptothiadiazole.

The dimercaptothiadiazole (may also be referred to as DMTD) salt may be derivable from 2,5-dimercapto-1,3,4-thiadiazole, or a hydrocarbyl-substituted 2,5-dimercapto-1,3,4-thiadiazole, or an oligomer thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form oligomers of two or more of said thiadiazole units.

In one embodiment the hydrocarbyl-substituted 2,5-dimercapto-1,3,4-thiadiazole (as well as the unsubstituted materials) are typically substantially soluble at 25° C. in non-polar media such as an oil of lubricating viscosity. Thus, the total number of carbon atoms in the hydrocarbyl-substituents, which tend to promote solubility, will generally be 8 or more, or 10 or more, or at least 12. If the thiadiazole has two or more hydrocarbyl groups, the number of carbon atoms per group may be below 8 provided the total number of carbons is 8 or more.

In another embodiment the hydrocarbyl-substituted 2,5-dimercapto-1,3,4-thiadiazole (as well as the unsubstituted materials) are typically substantially insoluble at 25° C. in non-polar media such as an oil of lubricating viscosity. Thus, the total number of carbon atoms in the hydrocarbyl-substituents, which tend to promote solubility, will generally be fewer than 8, or 6, or 4. If there are multiple hydrocarbyl substituents, typically each substituent will contain 4 or fewer carbon atoms.

By the term "substantially insoluble" it is meant that the dimercaptothiadiazole compound will typically dissolve to an extent of less than 0.1 weight percent, typically less than 0.01 or 0.005 weight percent in oil at room temperature (25° C.). A suitable hydrocarbon oil of lubricating viscosity in which the solubility may be evaluated is Chevron™ RLOP 100 N oil. The specified amount of the DMTD or substituted DMTD is mixed with the oil and the solubility may be evaluated by observing clarity versus the appearance of residual sediment after, e.g., 1 week of storage.

Examples of the dimercaptothiadiazole from which the dimercaptothiadiazole salt may be derivable include 2,5-(tert-octyldithio)-1,3,4-thiadiazole 2,5-(tert-nonyldithio)-1,3,4-thiadiazole, 2,5-(tert-decyldithio)-1,3,4-thiadiazole, 2,5-(tert-undecyldithio)-1,3,4-thiadiazole, 2,5-(tert-dodecyldithio)-1,3,4-thiadiazole, 2,5-(tert-tridecyldithio)-1,3,4-thiadiazole, 2,5-(tert-tetradecyldithio)-1,3,4-thiadiazole, 2,5-(tert-pentadecyldithio)-1,3,4-thiadiazole, 2,5-(tert-hexadecyldithio)-1,3,4-thiadiazole, 2,5-(tert-heptadecyldithio)-1,3,4-thiadiazole, 2,5-(tert-octadecyldithio)-1,3,4-thiadiazole, 2,5-(tert-nonadecyldithio)-1,3,4-thiadiazole or 2,5-(tert-eicosyldithio)-1,3,4-thiadiazole, or oligomers thereof. In one embodiment the dimercaptothiadiazole includes 2,5-dimercapto-1,3,4-thiadiazole, or mixtures thereof.

In one embodiment the dimercaptothiadiazole salt (typically a 2,5-dimercapto-1,3,4-thiadiazole salt) may be derivable from reacting a dimercaptothiadiazole with an ethylenically unsaturated amide or ester. The amide or ester may include hydrocarbyl-(meth)acrylate or hydrocarbyl-(meth) acrylamide, a hydrocarbyl-substituted maleate, a hydrocarbyl-substituted crotonate, a hydrocarbyl-substituted cinnamate, or mixtures thereof.

In one embodiment the dimercaptothiadiazole salt (typically a 2,5-dimercapto-1,3,4-thiadiazole salt) may be derivable from a compound represented by the formula:

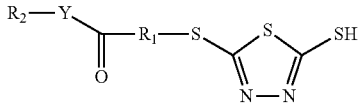

wherein $R_1$ may be an alkylene group containing 1 to 5, or 1 to 3, or 2 carbon atoms;

$R_2$ may be a hydrocarbyl group containing 1 to 16, or 2 to 8, or 4 carbon atoms;

Y may be —O— or $>NR_3$ (typically Y may be —O—; and $R_3$ may be hydrogen or $R_2$.

The dimercaptothiadiazole of the formula above may be prepared by reacting the appropriate hydrocarbyl-(meth) acrylate or hydrocarbyl-(meth)acrylamide with 2,5-dimercapto-1,3,4-thiadiazole.

The reaction of hydrocarbyl-(meth)acrylate or hydrocarbyl-(meth)acrylamide with 2,5-dimercapto-1,3,4-thiadiazole may be carried out at a temperature in the range of 50° C. to 150° C., or 70° C. to 120° C., or 80° C. to 100° C.

When the dimercaptothiadiazole salt is derivable from the reaction of hydrocarbyl-(meth)acrylate or hydrocarbyl-(meth)acrylamide with 2,5-dimercapto-1,3,4-thiadiazole, the reaction may be carried out prior to reaction with the copolymer, or in-situ.

In one embodiment the dimercaptothiadiazole salt (typically a 2,5-dimercapto-1,3,4-thiadiazole salt) may be derivable from reacting a dimercaptothiadiazole with an epoxide.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10). In one embodiment the oil of lubricating viscosity may be an API Group II, Group III, Group IV oil, or mixtures thereof.

The amount of the oil of lubricating viscosity present is typically the balance remaining after subtracting from 100 wt % the sum of the amount of the copolymer of the invention and the other performance additives.

The lubricating composition may be in the form of a concentrate and/or a fully formulated lubricant. If the copolymer of the present invention is in the form of a concentrate (which may be combined with additional oil to form, in whole or in part, a finished lubricant), the ratio of the of components the copolymer of the present invention to the oil of lubricating viscosity and/or to diluent oil include the ranges of 1:99 to 99:1 by weight, or 80:20 to 10:90 by weight.

Other Performance Additives

Compositions derived from the copolymer and/or lubricating compositions described herein optionally further includes other performance additives. The other performance additives comprise at least one of metal deactivators, detergents, dispersants, viscosity modifiers (other than the copolymer of the present invention), friction modifiers, corrosion inhibitors, dispersant viscosity modifiers (other than the copolymer of the present invention), antiwear agents (other than the copolymer of the present invention), extreme pressure agents (other than the copolymer of the present invention), antiscuffing agents, antioxidants, foam inhibitors, demulsifiers, pour point depressants, seal swelling agents and mixtures thereof. Typically, fully-formulated lubricating oil will contain one or more of these performance additives.

Dispersants

Dispersants are often known as ashless-type dispersants because, prior to mixing in a lubricating oil composition, they do not contain ash-forming metals and they do not normally contribute any ash forming metals when added to a lubricant and polymeric dispersants. Ashless type dispersants are characterised by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene from which it is derived in the range 350 to 5000, or 500 to 3000.

In one embodiment the invention further includes at least one dispersant derived from polyisobutylene, an amine and zinc oxide to form a polyisobutylene succinimide complex with zinc. The polyisobutylene succinimide complex with zinc may be used alone or in combination.

Another class of ashless dispersant is Mannich bases. Mannich dispersants are the reaction products of alkyl phenols with aldehydes (especially formaldehyde) and amines (especially polyalkylene polyamines). The alkyl group typically contains at least 30 carbon atoms.

The dispersants may also be post-treated by conventional methods by a reaction with any of a variety of agents. Among these are boron compounds (such as boric acid), urea, thiourea, dimercaptothiadiazoles, carbon disulphide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated.

In one embodiment the dispersant may be a post treated dispersant. The dispersant may be post treated with dimercaptothiadiazole, optionally in the presence of one or more of a phosphorus compound, an aromatic dicarboxylic acid, and a borating agent.

In one embodiment the post treated dispersant may be formed by heating an alkenyl succinimide or succinimide detergent with a phosphorus ester and water to partially hydrolyze the ester. The post treated dispersant of this type is disclosed for example in U.S. Pat. No. 5,164,103.

In one embodiment the post treated dispersant may be produced by preparing a mixture of a dispersant and a dimercaptothiadiazole and heating the mixture above about 100° C. The post treated dispersant of this type is disclosed for example in U.S. Pat. No. 4,136,043.

In one embodiment the dispersant may be post treated to form a product prepared comprising heating together: (i) a dispersant (typically a succinimide), (ii) 2,5-dimercapto-1,3,4-thiadiazole or a hydrocarbyl-substituted 2,5-dimercapto-1,3,4-thiadiazole, or oligomers thereof, (iii) a borating agent (similar to those described above); and (iv) optionally a dicarboxylic acid of an aromatic compound selected from the group consisting of 1,3 diacids and 1,4 diacids (typically terephthalic acid), or (v) optionally a phosphorus acid compound (including either phosphoric acid or phosphorous acid), said heating being sufficient to provide a product of (i), (ii), (iii) and optionally (iv) or optionally (v), which is soluble in an oil of lubricating viscosity. The post treated dispersant of this type is disclosed for example in International Application WO 2006/654726 A.

Detergents

The lubricant composition optionally further includes known neutral or overbased detergents, i.e., ones prepared by conventional processes known in the art. Suitable detergent substrates include, phenates, sulphur containing phenates, sulphonates, salixarates, salicylates, carboxylic acid, phosphorus acid, alkyl phenol, sulphur coupled alkyl phenol compounds, or saligenins.

Antioxidant

Antioxidant compounds are known and include sulphurised olefins, alkylated diarylamines, hindered phenols, molybdenum dithiocarbamates, and mixtures thereof. Antioxidant compounds may be used alone or in combination.

The hindered phenol antioxidant often contains a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant is an ester and may include, e.g., Irganox™ L-135 from Ciba. Suitable examples of molybdenum dithiocarbamates which may be used as an antioxidant include commercial materials sold under the trade names such as Vanlube 822™ and Molyvan™ A from R. T. Vanderbilt Co., Ltd., and Adeka Sakura-Lube™ S-100, S-165 and S-600 from Asahi Denka Kogyo K. K and mixtures thereof.

The alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the diphenylamine may include nonyl diphenylamine, or dinonyl diphenylamine. The alkylated diarylamine may include octyl, di-octyl, nonyl, dinonyl, decyl or di-decyl phenylnapthylamines.

Viscosity Modifiers

Viscosity modifiers, other than the copolymer of the present invention, include hydrogenated styrene-butadiene rubbers, ethylene-propylene copolymers, hydrogenated styrene-isoprene polymers, hydrogenated diene polymers, polyalkyl styrenes, polyolefins, polyalkyl(meth)acrylates and esters of maleic anhydride-styrene copolymers, or mixtures thereof. In one embodiment the polymeric viscosity modifier is a poly(meth)acrylate.

Antiwear Agent

The lubricating composition optionally further includes at least one antiwear agent. Examples of suitable antiwear agents include oil soluble amine salts of phosphorus compounds, sulphurised olefins, metal dihydrocarbyldithiophosphates (such as zinc dialkyldithiophosphates), thiocarbamate-containing compounds, such as thiocarbamate esters, thio carbamate amides, thiocarbamic ethers, alkylene-coupled thiocarbamates, and bis(S-alkyldithiocarbamyl)disulphides.

In one embodiment the oil soluble phosphorus amine salt antiwear agent includes an amine salt of a phosphorus acid ester or mixtures thereof. The amine salt of a phosphorus acid ester includes phosphoric acid esters and amine salts thereof; dialkyldithiophosphoric acid esters and amine salts thereof; amine salts of phosphites; and amine salts of phosphorus-containing carboxylic esters, ethers, and amides; and mixtures thereof. The amine salt of a phosphorus acid ester may be used alone or in combination.

In one embodiment the oil soluble phosphorus amine salt includes partial amine salt-partial metal salt compounds or mixtures thereof. In one embodiment the phosphorus compound further includes a sulphur atom in the molecule. In one embodiment the amine salt of the phosphorus compound is ashless, i.e., metal-free (prior to being mixed with other components).

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment the phosphorus acid amine salt includes an amine with C11 to C14 tertiary alkyl primary groups or mixtures thereof. In one embodiment the phosphorus acid amine salt includes an amine with C14 to C18 tertiary alkyl primary amines or mixtures thereof. In one embodiment the phosphorus acid amine salt includes an amine with C18 to C22 tertiary alkyl primary amines or mixtures thereof.

Mixtures of amines may also be used in the invention. In one embodiment a useful mixture of amines is "Primene® 81R" and "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

In one embodiment oil soluble amine salts of phosphorus compounds include a sulphur-free amine salt of a phosphorus-containing compound is obtained/obtainable by a process comprising: reacting an amine with either (i) a hydroxy-substituted di-ester of phosphoric acid, or (ii) a phosphorylated hydroxy-substituted di- or tri-ester of phosphoric acid. A more detailed description of compounds of this type is disclosed in International Application PCT/US08/051126 (or equivalent to U.S. application Ser. No. 11/627,405).

In one embodiment the hydrocarbyl amine salt of an alkylphosphoric acid ester is the reaction product of a C14 to C18 alkyl phosphoric acid with Primene 81R™ (produced and sold by Rohm & Haas) which is a mixture of C11 to C14 tertiary alkyl primary amines.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81R™, and mixtures thereof.

In one embodiment the dithiophosphoric acid may be reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, and styrene oxide. In one embodiment the epoxide is propylene oxide. The glycols may be aliphatic glycols having from 1 to 12, or from 2 to 6, or 2 to 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines. An example of suitable dithiophosphoric acid is prepared by adding phosphorus pentoxide (about 64 grams) at 58° C. over a period of 45 minutes to 514 grams of hydroxypropyl O,O-di(4-methyl-2-pentyl)phosphorodithioate (prepared by reacting di(4-methyl-2-pentyl)-phosphorodithioic acid with 1.3 moles of propylene oxide at 25° C.). The mixture is heated at 75° C. for 2.5 hours, mixed with a diatomaceous earth and filtered at 70° C. The filtrate contains 11.8% by weight phosphorus, 15.2% by weight sulphur, and an acid number of 87 (bromophenol blue).

The dithiocarbamate-containing compounds may be prepared by reacting a dithiocarbamate acid or salt with an unsaturated compound. The dithiocarbamate containing compounds may also be prepared by simultaneously reacting an amine, carbon disulphide and an unsaturated compound. Generally, the reaction occurs at a temperature from 25° C. to 125° C.

Examples of suitable olefins that may be sulphurised to form an the sulphurised olefin include propylene, butylene, isobutylene, pentene, hexane, heptene, octane, nonene, decene, undecene, dodecene, undecyl, tridecene, tetradecene, pentadecene, hexadecene, heptadecene, octadecene, octadecenene, nonodecene, eicosene or mixtures thereof. In one embodiment, hexadecene, heptadecene, octadecene, octadecenene, nonodecene, eicosene or mixtures thereof and their dimers, trimers and tetramers are especially useful olefins. Alternatively, the olefin may be a Diels-Alder adduct of a diene such as 1,3,butadiene and an unsaturated ester, such as butylacrylate.

In an alternative embodiment, the ashless antiwear agent may be a monoester of a polyol and an aliphatic carboxylic acid, often an acid containing 12 to 24 carbon atoms. Often the monoester of a polyol and an aliphatic carboxylic acid is in the form of a mixture with a sunflower oil or the like, which may be present in the friction modifier mixture from 5 to 95, in several embodiments from 10 to 90, or from 20 to 85, or 20 to 80 weight percent of said mixture. The aliphatic carboxylic acids (especially a monocarboxylic acid) which form the esters are those acids typically containing 12 to 24, or from 14 to 20 carbon atoms. Examples of carboxylic acids include dodecanoic acid, stearic acid, lauric acid, behenic acid, and oleic acid.

Another class of sulphurised olefin includes fatty acids and their esters. The fatty acids are often obtained from vegetable oil or animal oil; and typically contain 4 to 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. In one embodiment fatty acids and/or ester are mixed with olefins.

Polyols include diols, triols, and alcohols with higher numbers of alcoholic OH groups. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol. Often the polyol is diethylene glycol, triethylene glycol, glycerol, sorbitol, pentaerythritol or dipentaerythritol.

The commercially available monoester known as "glycerol monooleate" is believed to include 60±5 percent by weight of the chemical species glycerol monooleate, along with 35±5 percent glycerol dioleate, and less than 5 percent trioleate and oleic acid. The amounts of the monoesters, described above, are calculated based on the actual, corrected, amount of polyol monoester present in any such mixture.

Antiscuffing Agent

The lubricant composition may also contain an antiscuffing agent. Antiscuffing agent compounds are believed to decrease adhesive wear and are often sulphur containing compounds. Typically the sulphur containing compounds include sulphurised olefins, organic sulphides and polysulphides, such as dibenzyldisulphide, bis-(chlorobenzyl)disulphide, dibutyl tetrasulphide, di-tertiary butyl polysulphide, sulphurised methyl ester of oleic acid, sulphurised alkylphenol, sulphurised dipentene, sulphurised terpene, sulphurised Diels-Alder adducts, alkyl sulphenyl N'N-dialkyl dithiocarbamates, the reaction product of polyamines with polybasic acid esters, chlorobutyl esters of 2,3-dibromopropoxyisobutyric acid, acetoxymethyl esters of dialkyl dithiocarbamic acid and acyloxyalkyl ethers of xanthogenic acids and mixtures thereof.

Extreme Pressure Agents

Extreme Pressure (EP) agents that are soluble in the oil include sulphur- and chlorosulphur-containing EP agents, chlorinated hydrocarbon EP agents and phosphorus EP agents. Examples of such EP agents include chlorinated wax; sulphurised olefins (such as sulphurised isobutylene), organic sulphides and polysulphides such as dibenzyldisulphide, bis-(chlorobenzyl)disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Corrosion inhibitors that may be useful in the compositions of the invention include fatty amines, octylamine octanoate, condensation products of dodecenyl succinic acid or anhydride and a fatty acid such as oleic acid with a polyamine.

Foam inhibitors that may be useful in the compositions of the invention include copolymers of ethyl acrylate and 2-ethylhexylacrylate, and optionally vinyl acetate; demulsifiers including trialkyl phosphates, polyethylene glycols, polyethylene oxides, polypropylene oxides and (ethylene oxide-propylene oxide) polymers. Foam inhibitors may include silicone antifoam agents such as dimethyl siloxane polymers.

Pour point depressants that may be useful in the compositions of the invention include polyalphaolefins, esters of maleic anhydride-styrene copolymers, poly(meth)acrylates, polyacrylates or polyacrylamides.

As used herein the term "fatty alkyl" or "fatty" in relation to friction modifiers means a carbon chain having 10 to 22 carbon atoms, typically a straight carbon chain.

Friction modifiers that may be useful in the compositions of the invention include fatty acid derivatives such as amines, esters, epoxides, fatty imidazolines, condensation products of carboxylic acids and polyalkylene-polyamines and amine salts of alkylphosphoric acids, fatty phosphonate esters and reaction products from fatty carboxylic acids reacted with guanidine, aminoguanidine, urea, thiourea, and salts thereof. Friction modifiers thus include alkoxylated fatty amines, borated fatty epoxides, fatty phosphites (e.g., C16-18 alkyl phosphites), fatty epoxides, fatty amines, borated alkoxylated fatty amines, metal salts of fatty acids, fatty acid amides, glycerol esters, borated glycerol esters, fatty imidazolines, amine phosphate salts (e.g., salts of 2-ethylhexylamine), and salts of long chain alkyl phosphoric esters with long chain alkyl amines. "Fatty" materials are typically those that contain fatty alkyl groups, e.g., typically C8 to C22 alkyl groups, usually straight chain or sometimes mono-branched. The amount of such supplemental friction modifier, if present, may, for example, be 0.01 to 2 percent by weight of the fluid composition, or 0.05 to 1.2 percent, or 0.1 to 1 percent by weight.

Industrial Application

The method and lubricating composition of the invention may be utilised in refrigeration lubricants, greases, gear oils, axle oils, drive shaft oils, traction oils, manual transmission oils, automatic transmission oils, metal working fluids, hydraulic oils, or internal combustion engine oils. The gear oils, axle oils, drive shaft oils, manual transmission oils, automatic transmission oils may be collectively referred to as being used as part of a driveline device. In one embodiment the driveline device may be a gear or an axle, or a manual transmission.

In one embodiment the method and lubricating composition of the invention may be for at least one of gear oils, axle oils, drive shaft oils, traction oils, manual transmission oils or automatic transmission oils.

An automatic transmission includes continuously variable transmissions (CVT), infinitely variable transmissions (IVT), toroidal transmissions, continuously slipping torque converter clutches (CSTCC), stepped automatic transmissions or dual clutch transmissions (DCT).

The gear oil or axle oil may be used in a planetary hub reduction axle, a mechanical steering and transfer gear box in utility vehicles, a synchromesh gear box, a power take-off gear, a limited slip axle, and a planetary hub reduction gear box.

In several embodiments a suitable lubricating composition includes the copolymer present (on an actives basis) in ranges as shown in the following table.

TABLE

| Embodiments | wt % of Copolymer of the Invention | wt % of Other Performance Additives | wt % of Oil of Lubricating Viscosity |
|---|---|---|---|
| A | 0.1-70 | 0.5-20 | 10-99.4 |
| B | 1.5-65 | 0.5-15 | 20-98 |
| C | 10-60 | 0.5-15 | 25-89.5 |
| D | 15-60 | 0.5-15 | 25-84.5 |
| E | 18-46 | 0.5-15 | 58-81.5 |

In different embodiments the copolymer of the invention may be present at 0.1 wt % to 99.9 wt %, or 1 wt % to 70 wt %, or 1.5 wt % to 65 wt %, or 10 wt % to 60 wt %, or 15 wt % to 60 wt %, or 18 wt % to 46 wt %.

The following examples provide an illustration of the invention. These examples are non exhaustive and are not intended to limit the scope of the invention.

EXAMPLES

A 5 L flange flask is charged with 353 g of maleic anhydride, 606 g of 1-dodecene, and toluene (2372.8 g). The flask is fitted with a flange lid and clip, PTFE stirrer gland, rod and overhead stirrer, water-cooled condenser, thermocouple and nitrogen inlet. The flask is stirred under nitrogen. Trigonox®21S and toluene (315 g) are charged to a conical flask with side-arm and nitrogen is applied. The flask is heated to 105° C. The contents of the conical flask are charged to the flange flask via Masterflex™ pump (flow rate=1.2 ml/min$^{-1}$) over a period of 5 hours. The flask is cooled to 50° C. A Dean-Stark trap is fitted to the flask and the flask is heated to 120° C. to remove toluene before alcohol addition. The flask is cooled to 110° C. Alfol 810 (522 g) and methanesulphonic acid (24.7 g) are mixed together and charged to the flask via dropping funnel over 1.5 hours whilst heating to 145° C. The flask is stirred for 2 hours before cooling to ambient. The flask is heated to 145° C. The flask is stirred for a further 8 hours. A second methanesulphonic acid addition (12.4 g) is charged to the flask. A butanol addition (55.7 g) is then charged to the flask and stirred for 18 hours. A 2nd butanol addition is charged to the flask and stirred for 3 hours. A 3rd butanol addition is charged to the flask and stirred for 2.5 hours. A 4th butanol addition is charged to the flask and stirred for 18 hours. A 5th butanol addition is charged to the flask and stirred for 3 hours. A 6th butanol addition is charged to the flask and stirred for 3 hours. 16.82 g of sodium hydroxide (50 mol % in water) is charged to the flask whilst heating to 150° C. and left to stir for a further 45 minutes. 7.56 g of dimethylaminopropylamine (to deliver 0.1% nitrogen to the copolymer) is charged to the flask and then stirred for 2 hours. The apparatus is arranged for vacuum distillation. The flask is heated to 100° C. and vacuum is applied and held for 30 minutes. The flask is heated to 130° C. and held for 45 minutes. The flask is then heated to 150° C. and held for a further 3 hours. The flask is then cooled to 100° C. and vacuum removed. The product is filtered through diatomaceous earth to afford the desired ester copolymer having approx 0.1% N, 2 mg KOH/g TBN.

Polymer intermediate 2: Ester copolymer 2 (Esc2) is prepared using the general procedure outlined above using 3-morpholinopropan-1-amine to deliver 0.12% nitrogen, 2.2 mg KOH/g TBN, in place of dimethylaminopropylamine.

Polymer intermediate 3: Ester copolymer 3 (Esc3) is prepared using the general procedure outlined above using dimethylaminopropylamine to deliver 0.27% nitrogen, 4.8 mg KOH/g TBN.

Polymer intermediate 4: Ester copolymer 2 (Esc2) is prepared using the general procedure outlined above using 3-morpholinopropan-1-amine to deliver 0.25% nitrogen, approx 5 mg KOH/g TBN, in place of dimethylaminopropylamine.

Polymer Intermediate 5: Ester copolymer 3 (Esc3) is prepared using the general procedure outlined above dimethylaminopropylamine to deliver 5.6 mg KOH/g TBN.

Polymer intermediate 6: Ester copolymer 5 (Esc5) is prepared using the general procedure outlined above using dimethylaminopropylamine to deliver 0.4% nitrogen, approx 8 mg KOH/g TBN.

Polymer intermediate 7: Ester copolymer 2 (Esc2) is prepared using the general procedure outlined above using 3-morpholinopropan-1-amine to deliver 0.4% nitrogen, approx 8 mg KOH/g TBN, in place of dimethylaminopropylamine.

Copolymer of the Invention 1 (CPI1): A 5-L flange flask was fitted with an overhead stirrer, stirrer gland, thermocouple, nitrogen inlet 0.028 m$^3$/hr (or 1 SCFH), water cooled condenser and PTFE gasket. The flask is charged with the product of polymer intermediate 3 (2232 g) and dimercaptothiadiazole (28.46 g). The flask contents are stirred at 350 rpm. The flask is heated to 90° C. and n-butyl acrylate (26.7 g) is added over a period of 30 minutes. The contents of the flask are stirred for a further 30 minutes. The reaction mixture is heated to 130° C. and stirred for 18 hours. The flask contents are cooled to produce a brown viscous oil, the desired product. The copolymer sulfur content is 8116 ppm.

Copolymer of the Invention 2 (CPI2): A 5-L flange flask is fitted with an overhead stirrer, stirrer gland, thermocouple, nitrogen inlet 0.028 m$^3$/hr (or 1 SCFH), water cooled condenser and PTFE gasket. The flask is charged with the product of polymer intermediate 3 (2619 g) and dimercaptothiadiazole (33.34 g). The flask contents are stirred at 350 rpm. The flask is heated to 90° C. and bis 2-ethylhexyl maleate (83.22 g) is added over a period of 30 minutes. The contents of the flask are stirred for a further 30 minutes. The reaction mixture is heated to 130° C. and stirred for 18 hours. The flask contents are cooled to produce a brown viscous oil, the desired product. The copolymer sulfur content is 8325 ppm.

Copolymer of the Invention 3 (CPI3): A 5-L flange flask is fitted with an overhead stirrer, stirrer gland, thermocouple, nitrogen inlet 0.028 m$^3$/hr (or 1 SCFH), water cooled condenser and PTFE gasket. The flask is charged with the product of polymer intermediate 2 (2905 g) and dimercaptothiadiazole (17.04 g). The flask contents are stirred at 350 rpm. The flask is heated to 50° C. and n-butyl acrylate (15.99 g) is added over a period of 5 minutes. The reaction mixture is heated to 130° C. and stirred for 16 hours. The flask contents are cooled to produce a brown viscous oil, the desired product. The copolymer sulfur content is 3749 ppm.

Copolymer of the Invention 4 (CPI4): A 5-L flange flask is fitted with an overhead stirrer, stirrer gland, thermocouple, nitrogen inlet 0.028 m$^3$/hr (or 1 SCFH), water cooled condenser and PTFE gasket. The flask is charged with the product of polymer intermediate 2 (3125 g) and dimercaptothiadiazole (18.31 g). The flask contents are stirred at 350 rpm. The flask is heated to 50° C. and bis 2-ethylhexyl maleate (45.69 g) is added over a period of 5 minutes. The reaction mixture is heated to 130° C. and stirred for 20 hours. The flask contents are cooled to produce a brown viscous oil, the desired product. The copolymer sulfur content is 3134 ppm.

Copolymer of the Invention 5 (CPI5): A 5-L flange flask is fitted with an overhead stirrer, stirrer gland, thermocouple, nitrogen inlet 0.028 $m^3$/hr (or 1 SCFH), water cooled condenser and PTFE gasket. The flask is charged with the product of polymer intermediate 6 (3000 g) and dimercaptothiadiazole (63.99 g). The flask contents are stirred at 350 rpm. The flask is heated to 90° C. and n-butyl acrylate (60.04 g) is added over a period of 30 minutes. The reaction mixture is stirred for 30 minutes and heated to 130° C. The reaction mixture is stirred for 16 hours. The flask contents are cooled to produce a viscous oil, the desired product.

Copolymer of the Invention 6 (CPI6): A 5-L flange flask is fitted with an overhead stirrer, stirrer gland, thermocouple, nitrogen inlet 0.028 $m^3$/hr (or 1 SCFH), water cooled condenser and PTFE gasket. The flask is charged with the product of polymer intermediate 3 (2800 g) and dimercaptothiadiazole (59.41 g). The flask contents are stirred at 350 rpm. The flask is heated to 90° C. and bis 2-ethylhexyl maleate (148.29 g) is added over a period of 30 minutes. The contents of the flask are stirred for a further 30 minutes. The reaction mixture is heated to 130° C. and stirred for 16 hours. The flask contents are cooled to produce a viscous oil, the desired product.

A series of manual transmission lubricants are prepared (MCE1, MEX1 and MEX2) containing 76 wt % of polyalphaolefin (4 $mm^2$/s or cSt, may also be referred to as PAO-4), phosphorus antiwear agent to provide about 530 ppm phosphorus, a borated dispersant to provide about 93 ppm boron, 0.2 wt % of oleyl amine, and 2 wt % of a 300 TBN calcium sulphonate detergent. In addition, CE1 contains 18.8 wt % of a polymer of polymer intermediate 2; and MEX1 and MEX2 contain 18.8 wt % of CPI3 and CPI4, respectively.

CE1, MEX1 and MEX2 are evaluated by methodologies described in ASTM D445 (kinematic viscosity at 40° C. (KV40) and 100° C. (KV100)), ASTM Method D2270 (viscosity index (VI)) and ASTM D2783 (4-ball wear test for extreme pressure performance). The data obtained is as follows:

| | CE1 | MEX1 | MEX2 |
|---|---|---|---|
| KV40 (mm2/s) | 7.9 | 7.8 | 7.9 |
| KV100 | 38.7 | 38.6 | 38.7 |
| VI | 181 | 200 | 180 |
| 4-Ball Data | | | |
| Load Wear Index (kg) | 42.1 | 45.4 | 38.2 |
| Weld Point | 200 | 250 | 250 |
| Seizure Load (kg) | 126 | 126 | 100 |

The data indicates the inventive lubricating composition has improved weld performance over the comparative example.

A series of axle gear lubricants are prepared ACE1 (axle comparative example 1) and AXEX1 (axle gear lubricant inventive example 1) containing sufficient phosphorus antiwear agent to deliver about 1474 ppm of phosphorus, 0.13 wt % oleylamide, about 4 wt % sulphurised olefin, and 1.25 wt % of borated dispersant (to deliver about 235 ppm of boron). ACE1 also contains 51.26 wt % of PAO-4 and 38.6 wt % of polymer intermediate 2. AXEX1 also contains 36.8 wt % of the product of CPI3 and 53.34 wt % PAO-4.

ACE1 and AXEX1 are evaluated by the methodologies of ASTM Method D445 (to measure KV40 and KV100), ASTM Method D2270 (to measure VI), and L-42 test (ASTM Method D7452). L-42 measures load carrying properties of lubricants used in final drive axles, under conditions of high speed and shock loading. The L-42 test evaluates scuffing and scoring of a surface of the coast side of a gear relative to a reference fluid (specified by L-42 test) and a lower rating at the end of test (EOT) indicates a better result. Lower ratings on scuffing indicate a lubricant is able to minimize gear distress under shock loading. The results obtained for the various ASTM tests performed on ACE1 and AXEX1 are:

| | ACE1 | AXEX1 |
|---|---|---|
| KV40 | 15.53 | 14.45 |
| KV100 | 84.37 | 77.63 |
| VI | 196 | 195 |
| L-42 Data | | |
| EOT Ring Drive (%) | 0 | 0 |
| EOT Ring Coast (%) | 7 | 5 |
| EOT Pinion Drive (%) | 0 | 0 |
| EOT Pinion Coast (%) | 14 | 9 |

The reference oil specified by L-42 test has a coast average ring scoring rating of 12, and coast average pinion scoring rating of 16. Comparing the data from the reference fluid with ACE1 and AXEX1 indicates that a lubricating composition of the invention is capable of reducing scuffing and minimizing gear distress under shock loading.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0137] to [0141] of published application US 2010-0197536.

Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated.

Each of the documents referred to above is incorporated herein by reference. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising an oil of lubricating viscosity and a dimercaptothiadiazole salt of a copolymer, the copolymer comprising units derived from monomers (i) an α-olefin and (ii) an ethylenically unsaturated carboxylic acid or derivatives thereof, that are partially esterified with an alcohol, or mixtures thereof, and wherein at least a portion of carboxylic acid groups not esterified are reacted with an amine, wherein the amine is capable of providing a TBN (total base number) of greater than 0 mg KOH/g, and wherein the copolymer is salted with a dimercaptothiadiazole represented by the formula:

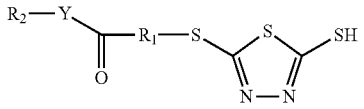

wherein $R_1$ is an alkylene group containing 1 to 5 carbon atoms; $R_2$ is a hydrocarbyl group containing 1 to 16 carbon atoms; Y is —0— or $>NR_3$; and $R_3$ is hydrogen or $R_2$.

2. The lubricating composition of claim 1, wherein the α-olefin is a linear or branched olefin, or mixtures thereof.

3. The lubricating composition of claim 1, wherein the α-olefin includes 1-decene, 1-undecene, 1-dodecene, 1-tridecene, 1-tetradecene, 1-pentadecene, 1-hexadecene, 1-heptadecene 1-octadecene, or mixtures thereof.

4. The lubricating composition of claim 1, wherein the α-olefin is 1-dodecene.

5. The lubricating composition of claim 1, wherein the ethylenically unsaturated carboxylic acid or derivatives thereof includes itaconic anhydride, maleic anhydride, methyl maleic anhydride, ethyl maleic anhydride, dimethyl maleic anhydride or mixtures thereof.

6. The lubricating composition of claim 1, wherein the ethylenically unsaturated carboxylic acid or derivatives thereof is maleic anhydride or derivatives thereof.

7. The lubricating composition of claim 1, wherein the α-olefin is 1-dodecene and the (ii) unsaturated carboxylic acid or derivatives thereof is maleic anhydride.

8. The lubricating composition of claim 1, wherein the copolymer has, prior to esterification, a reduced specific viscosity of up to 0.08.

9. The lubricating composition of claim 1, wherein the alcohol is a linear or branched alcohol, a cyclic or acyclic alcohol, or a combination of features thereof.

10. The lubricating composition of claim 1, wherein the alcohol comprises a primary alcohol branched at the β-or higher position having at least 12 carbon atoms.

11. The lubricating composition of claim 1, wherein the alcohol comprises a mixture of (i) a Guerbet alcohol and (ii) a linear alcohol containing 6 to 20, or 8 to 18, or 10 to 15 carbon atoms other than a Guerbet alcohol.

12. The lubricating composition of claim 1, wherein the amine includes an amino-hydrocarbyl morpholine, an aminoalcohol, vinyl pyridine, N-vinyl imidazole, a dialkylaminoalkyl (meth)acrylamide or dialkylaminoalkyl (meth) acrylate, an N-substituted alkanediamine, or mixtures thereof.

13. The lubricating composition of claim 12, wherein the amino alcohol includes at least one of dimethylethanolamine, ethanolamine, isopropanolamine, diethanolamine, triethanolamine, N,N-diethylethanolamine, N,N-dibutylethanolamine, 3-amino-1,2-propanediol, serinol, 2-amino-2-methyl -1,3,propanediol, tris(hydroxymethyl)-aminomethane, diisopropanolamine, N-methyldiethanolamine, 3-(dimethylamino)-2,2-dimethylpropan-1-ol, and 2-(2-aminoethylamino)ethanol.

14. A method of lubricating a mechanical device comprising supplying to the device a lubricating composition of claim 1.

15. The method of claim 14, wherein the mechanical device is a driveline device.

16. The method of claim 14, wherein the mechanical device comprises at least one of planetary hub reduction axle, a mechanical steering and transfer gear box in a utility vehicle, a synchromesh gear box, a power take-off gear, a limited slip axle, and a planetary hub reduction gear box.

* * * * *